US008414305B2

(12) United States Patent
Sun

(10) Patent No.: US 8,414,305 B2
(45) Date of Patent: Apr. 9, 2013

(54) CONNECTOR ASSEMBLY

(75) Inventor: Zheng-Heng Sun, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 255 days.

(21) Appl. No.: 12/763,190

(22) Filed: Apr. 19, 2010

(65) Prior Publication Data

US 2011/0159707 A1 Jun. 30, 2011

(30) Foreign Application Priority Data

Dec. 29, 2009 (CN) ..... 2009 1 0312564

(51) Int. Cl.
*H01R 12/00* (2006.01)

(52) U.S. Cl. ..... 439/62

(58) Field of Classification Search ..... 439/62, 439/157, 160, 326, 637, 152
See application file for complete search history.

(56) References Cited

U.S. PATENT DOCUMENTS

| | | | | |
|---|---|---|---|---|
| 4,129,351 | A * | 12/1978 | Sugimoto et al. | 439/325 |
| 5,244,403 | A * | 9/1993 | Smith et al. | 439/326 |
| 5,372,518 | A * | 12/1994 | Liu et al. | 439/326 |
| 5,383,792 | A * | 1/1995 | Korsunsky et al. | 439/326 |
| 6,616,466 | B2 * | 9/2003 | Frantum et al. | 439/157 |
| 6,863,572 | B1 * | 3/2005 | Yi et al. | 439/637 |
| 6,981,886 | B1 * | 1/2006 | Co et al. | 439/160 |
| 7,248,470 | B2 * | 7/2007 | Chen et al. | 361/679.41 |
| 8,187,031 | B2 * | 5/2012 | Li et al. | 439/567 |
| 2007/0155245 | A1 * | 7/2007 | Tsai | 439/637 |
| 2008/0124967 | A1 * | 5/2008 | Hsieh | 439/377 |

* cited by examiner

*Primary Examiner* — Jean F Duverne
(74) *Attorney, Agent, or Firm* — Altis Law Group, Inc.

(57) ABSTRACT

A connector assembly includes a peripheral component interconnect express (PCI-E) connector and a fixing member. A groove is defined in the PCI-E connector and extends through an end of the PCI-E connector. The fixing member is fixed to the end of the PCI-E connector. A receiving slot is defined in the fixing member communicating with the groove of the PCI-E connector. The fixing member cooperates with the PCI-E connector to receive and protect a PCI-E card which has a length greater than the length of the PCI-E connector.

3 Claims, 4 Drawing Sheets

CONNECTOR ASSEMBLY

BACKGROUND

1. Technical Field

The present disclosure relates to a connector assembly.

2. Description of Related Art

A motherboard generally includes a plurality of peripheral component interconnect express (PCI-E) connectors, such as PCI-E ×1, PCI-E ×4, PCI-E ×8, and PCI-E ×16 connectors, to connect to corresponding PCI-E cards. Sometimes, a PCI-E connector, such as a PCI-E ×8 connector, uses an open-ended socket, to permit a physically longer PCI-E card, such as a PCI-E ×16 card, to be connected to the PCI-E connector. However, because the PCI-E card is longer than the PCI-E connector, the connection between the PCI-E card and the PCI-E connector is precarious. Some of the pins of the PCI-E card will be exposed out of the PCI-E connector, and are susceptible to being damaged.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
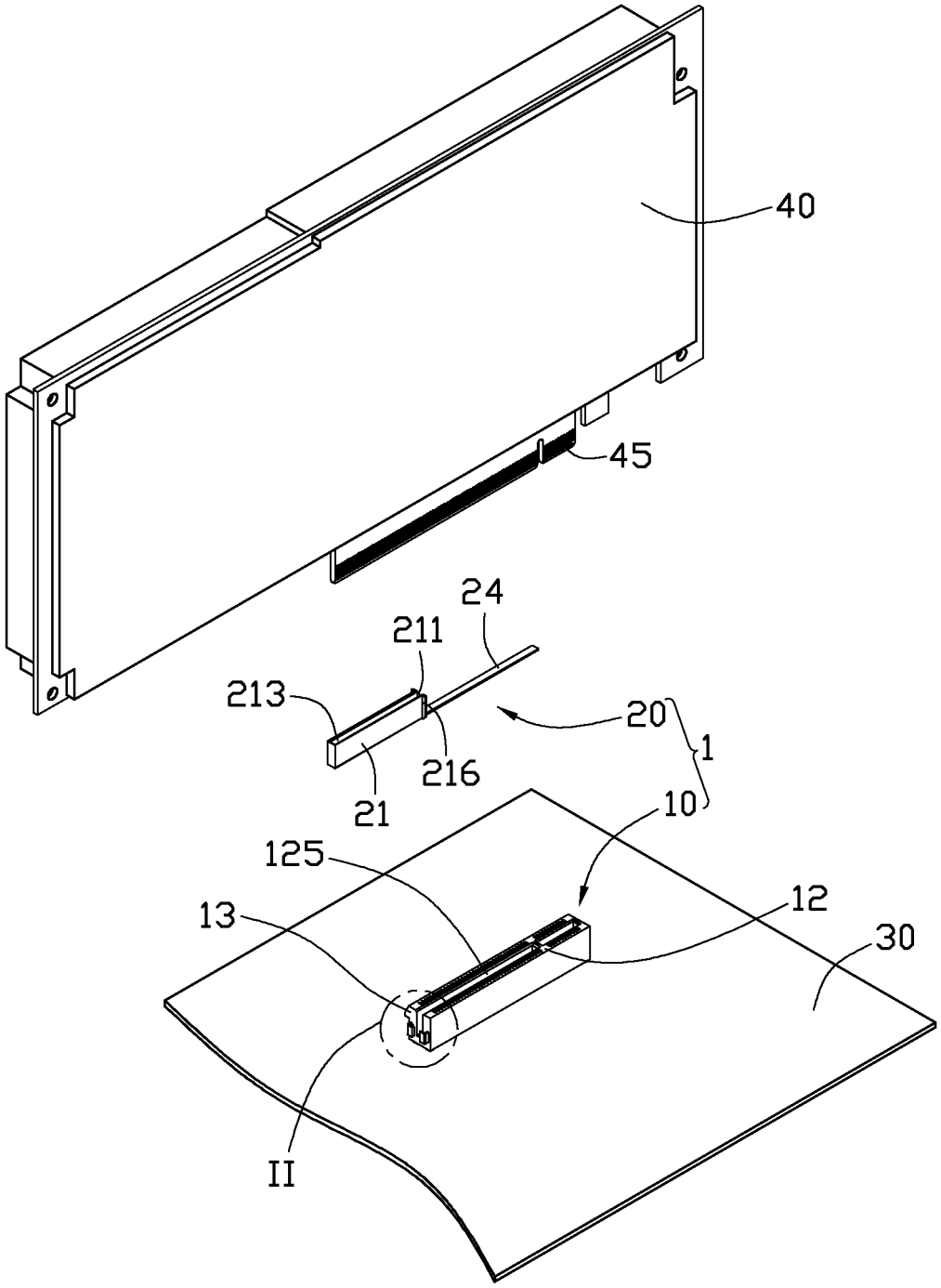
FIG. 1 is an exploded, isometric view of an exemplary embodiment of a connector assembly together with a motherboard and a peripheral component interconnect express (PCI-E) card.
Figure 2:
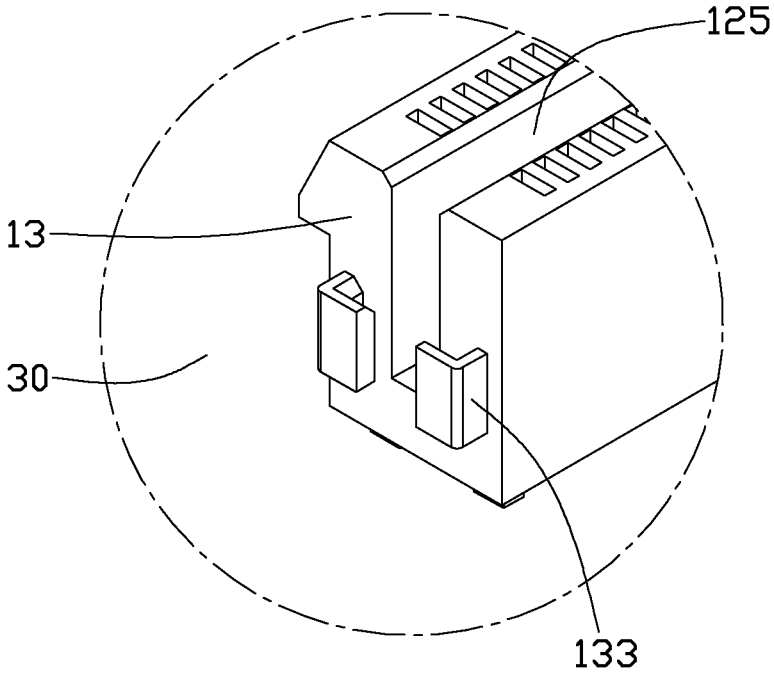
FIG. 2 is an enlarged, isometric view of a circled portion II of FIG. 1.

Referring to FIGS. 1 and 2, an exemplary embodiment of a connector assembly 1 includes a peripheral component interconnect express (PCI-E) connector 10 and a fixing member 20. In this embodiment, the PCI-E connector 10 is a PCI-E ×8 connector.

The PCI-E connector 10 is installed on a motherboard 30, and includes a top wall 12 and an end wall 13 perpendicular to the top wall 12. A groove 125 is defined in the top wall 12, with an end of the groove 125 extending through the end wall 13. Two support portions 133 are formed on the end wall 13 adjacent to two sides of the groove 125 respectively. Each support portion 133 is roughly box shaped and open on two adjacent sides to support an element described in the following paragraph.

The fixing member 20 includes a receiving portion 21 and an elongated fixing piece 24. The receiving portion 21 includes an end wall 211. A receiving slot 213 is defined in a top of the receiving portion 21, with an end of the receiving slot 213 extending through the end wall 211. The fixing piece 24 extends from a bottom of the end wall 211 of the receiving portion 21. Two arms 216 perpendicularly extend out from opposite sides of the end wall 211.

Figure 3:
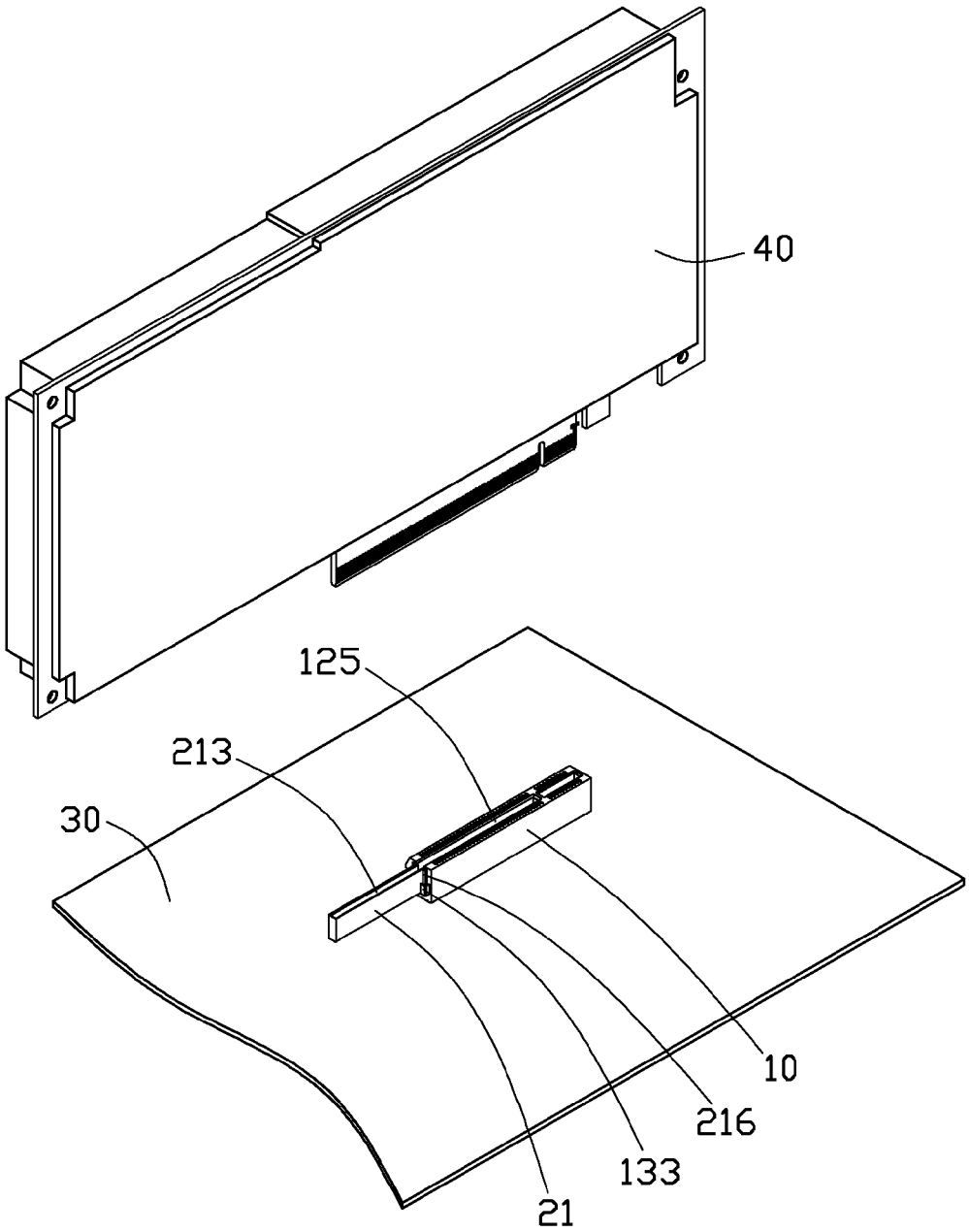
FIG. 3 is a partially assembled, isometric view of FIG. 1.

Referring to FIG. 3, to assemble the connector assembly 1, the fixing member 20 is placed over the PCI-E connector 10, with the fixing piece 24 of the fixing member 20 aligning with the groove 125 of the PCI-E connector 10, and the arms 216 of the fixing member 20 aligning with the support portions 133 of the PCI-E connector 10. The fixing member 20 is pressed down, allowing the arms 216 to correspondingly engage with the support portions 133 and be supported by the support portions 133. The fixing piece 24 of the fixing member 20 is received in the groove 125 of the PCI-E connector 10 and abuts against a bottom of the groove 125; the fixing member 20 is fixed to the PCI-E connector 10. The receiving slot 213 of the fixing member 20 is in communication with the groove 125 of the PCI-E connector 10.

In use, a PCI-E card having the same length as the PCI-E connector 10, such as a PCI-E ×8 card, or a PCI-E card having a length less than the length of the PCI-E connector 10, such as a PCI-E ×1 card or a PCI-E ×4 card, can be inserted into the groove of the PCI-E connector 10 directly.

Figure 4:
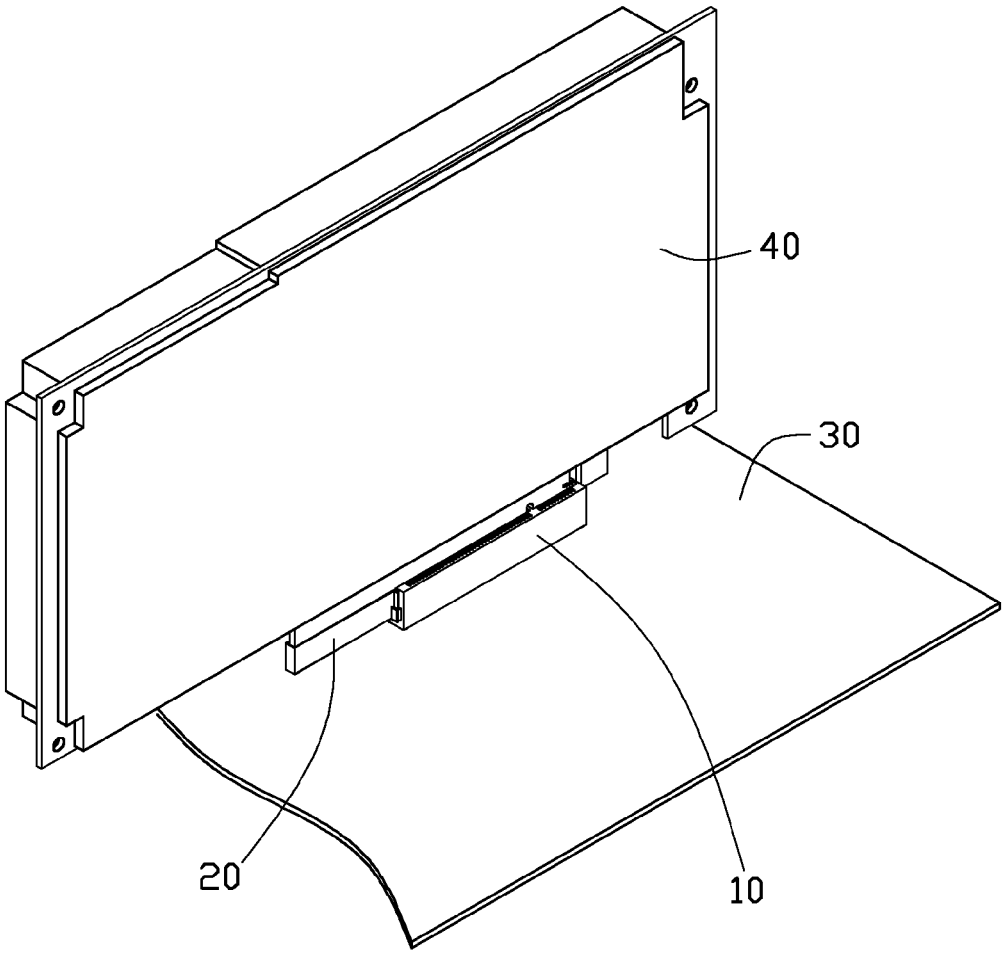
FIG. 4 is an assembled, isometric view of FIG. 1.

Referring to FIG. 4, to install a PCI-E card 40 having a length greater than the length of the PCI-E connector 10, such as a PCI-E ×16 card, a plurality of pins 45 formed on a bottom of the PCI-E card 40 is inserted into the groove 125 of the PCI-E connector 10 and the receiving slot 213 of the fixing member 20. The fixing piece 24 of the fixing member 20 is pressed by part of the plurality of pins 45, thereby, the PCI-E card 40 is connected to the connector assembly 1. The plurality of pins 45 is completely received in the PCI-E connector 10 and the fixing member 20, which can protect the plurality of pins 45 from knock and short circuit.

In another embodiment, the fixing piece 24 of the fixing member 20 can be omitted. The fixing member 20 is fixed to the end wall 13 of the PCI-E connector 10 via the engagement of arms 216 and the support portions 133.

It is to be understood, however, that even though numerous characteristics and advantages of the present disclosure have been set forth in the foregoing description, together with details of the structure and function of the disclosure, the disclosure is illustrative only, and changes may be made in details, especially in matters of shape, size, and arrangement of parts within the principles of the disclosure to the full extent indicated by the broad general meaning of the terms in which the appended claims are expressed.

What is claimed is:

1. A connector assembly, comprising:

a peripheral component interconnect express (PCI-E) connector comprising a top wall and an end wall perpendicular to the top wall; wherein a groove is defined in the top wall with an end of the groove extending through the end wall to receive a part of a PCI-E card which has a length longer than a length of the groove; and a fixing member comprising a receiving portion detachably mounted to the end wall of the PCI-E connector in an end to end way, and a receiving slot defined in the receiving portion and communicating with the groove of the PCI-E connector to receive the rest part of the PCI-E card, wherein the fixing member comprises an elongate fixing piece extending from a bottom of an end of the receiving portion which abuts against the end wall of the PCI-E connector, and received in the groove to be sandwiched between a bottom wall of the PCI-E connector and a bottom of the PCI-E card.

2. The connector assembly of claim 1, wherein two support portions are formed on an outer surface of the end wall of the PCI-E connector adjacent opposite sides of the groove respectively, two arms extend outwardly from opposite sides of an end of the receiving portion respectively, to correspondingly engage with the support portions of the PCI-E connector.

3. The connector assembly of claim 2, wherein each of the support portions is roughly box shaped and open on two adjacent sides to support a corresponding arm of the fixing member.

* * * * *